US010919292B2

(12) United States Patent
Taguchi

(10) Patent No.: US 10,919,292 B2
(45) Date of Patent: Feb. 16, 2021

(54) EJECTION APPARATUS

(71) Applicant: FUJI XEROX CO., LTD., Tokyo (JP)

(72) Inventor: Yoshiyuki Taguchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/680,587

(22) Filed: Nov. 12, 2019

(65) Prior Publication Data

US 2020/0316934 A1 Oct. 8, 2020

(30) Foreign Application Priority Data

Apr. 5, 2019 (JP) ..... JP2019-072586

(51) Int. Cl.
*B41J 2/045* (2006.01)
*B41J 13/00* (2006.01)

(52) U.S. Cl.
CPC ..... *B41J 2/04505* (2013.01); *B41J 2/04586* (2013.01); *B41J 13/0009* (2013.01)

(58) Field of Classification Search
CPC ..... B41J 2/04505; B41J 2/04586; B41J 2/04508; B41J 13/0009; B41J 2/125
See application file for complete search history.

(56) References Cited

U.S. PATENT DOCUMENTS

2005/0025352 A1 2/2005 Suzuki et al.
2007/0229559 A1* 10/2007 Oku ..... B41J 2/0458 347/9

FOREIGN PATENT DOCUMENTS

JP 2004-050481 2/2004
JP 2005-011980 1/2005

* cited by examiner

*Primary Examiner* — Thinh H Nguyen
(74) *Attorney, Agent, or Firm* — Fildes & Outland, P.C.

(57) ABSTRACT

An ejection apparatus includes: a feeding unit that feeds a recording medium; a first ejection unit that ejects droplets onto the recording medium to form plural detection images along a feeding direction of the recording medium, a detection unit that detects a distance from a predetermined origin of the recording medium to each of the detection images along the feeding direction; and a second ejection unit that is disposed on a downstream side relative to the first ejection unit in the feeding direction of the recording medium, and ejects droplets onto the recording medium at a timing based on a value obtained by adding an average value of differences between detection values of the detection unit and setting values to a setting value of the detection image on most downstream side in the feeding direction.

18 Claims, 9 Drawing Sheets

EJECTION APPARATUS

CROSS-REFERENCE TO RELATED APPLICATIONS

This application is based on and claims priority under 35 USC 119 from Japanese Patent Application No. 2019-072586 filed on Apr. 5, 2019.

BACKGROUND

1. Technical Field

The present invention relates to an ejection apparatus.

2. Related Art

JP-A-2004-050481 discloses an inkjet recording apparatus that performs print on a sheet by ejecting ink from an inkjet head. The inkjet recording apparatus includes: a feeding unit that feeds the sheet based on an ideal feeding amount that is a feeding amount of sheets should be fed; a detection unit that detects a difference between the ideal feeding amount and an effective feeding amount that is a feeding amount of sheets fed by the feeding unit based on the ideal feeding amount; a correction unit that determines, based on the difference detected by the detection unit, a correction amount for correcting a relative position between the sheet and the inkjet head; and a position control unit that controls a relative position between the sheet and the inkjet head based on the ideal feeding amount and the correction amount.

SUMMARY

In this regard, provided is a conceivable configuration which forms plural detection images along a feeding direction by ejecting droplets from a first ejection unit to a recording medium, which detects a distance from a predetermined origin of the recording medium to a detection image on the most downstream side along a feeding direction, and a distance between the detection images along the feeding direction, and which calculates a distance from the origin to each of the detection images along the feeding direction based on the detection value. When an ejection timing of a second ejection unit, which is disposed on a downstream side relative to the first ejection unit in a feeding direction of the recording medium, is determined based on the distance that is calculated in this configuration and is from the origin to each of the detection images along the feeding direction, a position shift may occur between an ejection position of the first ejection unit to the recording medium and an ejection position of the second ejection unit to the recording medium.

Aspects of non-limiting embodiments of the present disclosure relate to prevent the position shift between the ejection position of the first ejection unit to the recording medium and the ejection position of the second ejection unit to the recording medium, as compared with the case of detecting the distance from the origin to the detection image on the most downstream side along the feeding direction and the distance between the detection images along the feeding direction, and calculating the distance from the origin to each of the detection images along the feeding direction based on the detection value.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an ejection apparatus including: a feeding unit that feeds a recording medium; a first ejection unit that ejects droplets onto the recording medium to farm plural detection images along a feeding direction, a detection unit that detects a distance from a predetermined origin of the recording medium to each of the detection images along the feeding direction; and a second ejection unit that is disposed on a downstream side relative to the first ejection unit in the feeding direction of the recording medium, and ejects droplets onto the recording medium at a timing based on a value obtained by adding an average value of differences between detection values of the detection unit and setting values to a setting value of a detection image on the most downstream side in the feeding direction.

BRIEF DESCRIPTION OF THE DRAWINGS

Exemplary embodiments of the present invention will be described in detail based on the following figures, wherein.

DETAILED DESCRIPTION

An example of an exemplary embodiment of the present invention will be described below with reference to the drawings.

(Inkjet Recording Apparatus 10)

Figure 1:
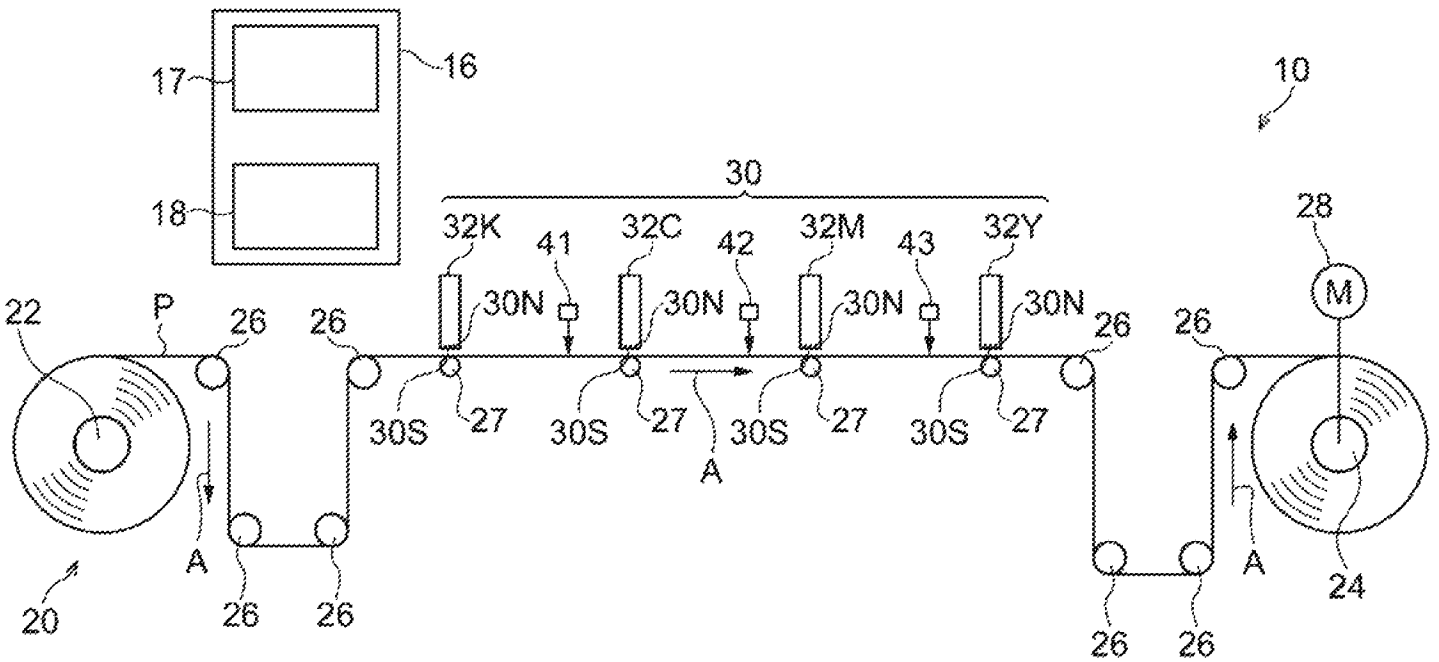
FIG. 1 is a schematic diagram showing a configuration of an inkjet recording apparatus according to the present exemplary embodiment.

First, an inkjet recording apparatus 10 will be described. FIG. 1 is a schematic diagram showing a configuration of the inkjet recording apparatus 10.

The inkjet recording apparatus 10 shown in FIG. 1 is an example of an ejection apparatus that ejects droplets. Specifically, the inkjet recording apparatus 10 ejects ink droplets to a recording medium. More specifically, as shown in FIG. 1, the inkjet recording apparatus 10 ejects ink droplets to a continuous sheet P (an example of the recording medium) to form an image on the continuous sheet P. In other words, the inkjet recording apparatus 10 is also an example of an image forming apparatus that forms an image on a recording medium. The continuous sheet P is an elongated recording medium having a length in a feeding direction of the continuous sheet to be fed. Specifically, the continuous sheet P is also a kind of paper in which plural pages are arranged along the feeding direction.

As shown in FIG. 1, the inkjet recording apparatus 10 includes a feeding mechanism 20, an ejection mechanism 30, sensing units 41, 42, and 43, and a control device 16. Hereinafter, specific configurations of the units (the feeding mechanism 20, the ejection mechanism 30, the sensing units 41, 42, and 43, and the control unit 16) of the inkjet recording apparatus 10 will be described.

(Feeding Mechanism 20)

The feeding mechanism 20 shown in FIG. 1 is an example of a feeding unit that feeds a recording medium. Specifically, the feeding mechanism 20 is a mechanism for feeding the continuous sheet P. More specifically, as shown in FIG. 1, the feeding mechanism 20 includes a wind-off roller 22, a wind-up roller 24, plural winding rollers 26, and plural support rollers 27.

The wind-off roller 22 is a roller for unwinding the continuous sheet P. The continuous sheet P is previously wound around the wind-off roller 22. The winding roller 22 unwinds the wound continuous sheet P via rotation.

The plural winding rollers 26 are rollers around which the continuous sheet P is wound and stretched. Specifically, the plural winding rollers 26 wind around the continuous sheet P, between the wind-off roller 22 and the wind-up roller 24. Accordingly, a feeding path of the continuous sheet P from the wind-off roller 22 to the wind-up roller 24 is determined. Each of the plural support rollers 27 is a roller for supporting the continuous sheet P on a lower side of each of ejection heads 32Y, 32M, 32C, and 32K in the ejection mechanism 30 to be described below.

The wind-up roller 24 is a roller for winding up the continuous sheet P thereon. The wind-up roller 24 is driven by a drive unit 28 to rotate. As a result, the wind-up roller 24 winds up the continuous sheet P, and simultaneously, the wind-off roller 22 unwinds the continuous sheet P. Then, the continuous sheet P is wound up by the wind-up roller 24 and is fed by being unwound by the wind-off roller 22. The plural winding rollers 26 and the plural support rollers 27 rotate following the continuous sheet P being fed. In the drawings, the feeding direction of the continuous sheet P (hereinafter, sometimes referred to as a "paper feeding direction") is indicated by an arrow A as appropriate.

The configuration of the feeding mechanism 20 is not limited to the above-described configuration. For example, the feeding mechanism 20 may have a configuration such that the continuous sheet P may be fed from a storage unit in which the continuous sheet P is accommodated in a folded state to a storage unit in which the continuous sheet P is to be accommodated so as to be folded. The feeding mechanism 20 may have a configuration in which a pair of feeding rollers, a feeding belt, or the like may be used as a feeding member that feeds the continuous sheet P.

Further, the continuous sheet P is used as the recording medium in the present exemplary embodiment, but the present invention is not limited thereto. For example, cut paper may be used as the recording medium.

(Ejection Mechanism 30)

The ejection mechanism 30 shown in FIG. 1 is a mechanism for ejecting ink droplets as an example of liquid droplets. Specifically, the ejection mechanism 30 ejects ink droplets onto the continuous sheet P fed by the feeding mechanism 20 to form an image. More specifically, as shown in FIG. 1, the ejection mechanism 30 includes ejection heads 32Y, 32M, 32C, and 32K (hereinafter, referred to as 32Y to 32K).

Each of the ejection heads 32Y to 32K is a head that ejects ink droplets. Specifically, each of the ejection heads 32Y to 32K ejects ink droplets of respective colors of yellow (Y), magenta (M), cyan (C), and black (K) onto the continuous sheet P to form an image on the continuous sheet P. More specifically, each of the ejection heads 32Y to 32K is configured as follows.

As shown in FIG. 1, the ejection heads 32Y to 32K are disposed in this order toward an upstream side in the paper feeding direction. Each of the ejection heads 32Y to 32K has a length in a width direction of the continuous sheet P (hereinafter, sometimes referred to as "paper width direction"). The paper width direction is a direction which intersects the paper feeding direction (specifically, a direction which is orthogonal to the paper feeding direction).

Each of the ejection heads 32Y to 32K has a nozzle surface 30S on which a nozzle 30N is formed. The nozzle surfaces 30S of the ejection heads 32Y to 32K face downward and face the continuous sheet P fed by the feeding mechanism 20. Each of the ejection heads 32Y to 32K ejects ink droplets from the nozzle 30N to the continuous sheet P according to a known method such as a thermal method and a piezoelectric method.

Examples of the ink used in each of the ejection heads 32Y to 32K include aqueous ink and oily ink. The aqueous ink contains, for example, a solvent containing water as a main component, and a colorant (specifically, a pigment or a dye), and other additives. The oily ink includes, for example, an organic solvent, a colorant (specifically, a pigment or a dye), and other additives.

Figure 2:
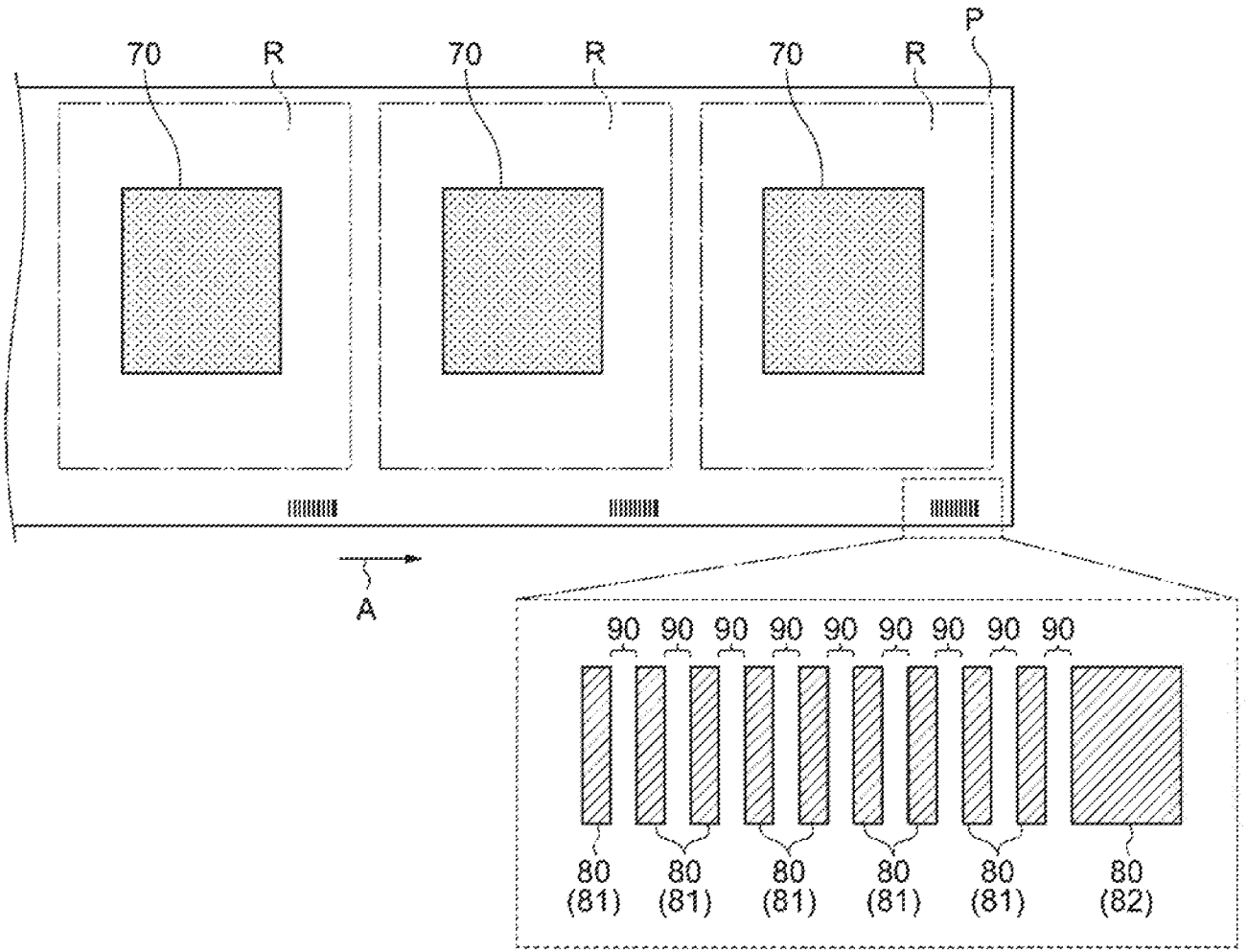
FIG. 2 is a schematic diagram showing plural detection marks formed on a continuous sheet according to the present exemplary embodiment.

Here, the ejection head 32K is an example of a first ejection unit. The ejection head 32K ejects ink droplets onto the continuous sheet P to form a normal image 70 and plural detection marks 80 as shown in FIG. 2. In other words, the detection marks 80 are formed by the ejection head disposed at the most upstream side in the paper feeding direction.

The normal image 70 is an image formed on an image area R of each page of the continuous sheet P. The normal image 70 is also an image formed based on an instruction of image formation that is input via a user terminal or the like. More specifically, the normal image 70 is also an image formed based on image data acquired by the control device 16 together with the image formation instruction.

On the other hand, the plural detection marks 80 are an example of a detection image, and are images formed outside the image areas R of pages of the continuous sheet P, respectively. The plural detection marks 80 are images detected by the sensing units 41, 42, and 43. More specifically, the plural detection marks 80 are also images formed regardless of image data acquired by the control device 16 together with an instruction of image formation. In other words, the plural detection marks 80 can be formed in a predetermined pattern based on pre-stored image data.

In the present exemplary embodiment, as shown in FIG. 2, the ejection head 32K forms plural (specifically, for example, 10) detection marks 80 along the paper feeding direction. Specifically, the ejection head 32K forms, for example, nine first detection marks 81 and one second detection mark 82 as the plural detection marks 80. In other words, the plural detection marks 80 include nine first detection marks 81 and one second detection mark 82. The plural detection marks 80 are formed for each page of the continuous sheet P. The first detection mark 81 is an example of a first detection image. The second detection mark 82 is an example of a second detection image.

Each of the first detection marks 81 and the second detection mark 82 are formed into a rectangular shape elongated in the paper width direction. That is, each of the first detection marks 81 and the second detection mark 82 are formed into a rectangular shape in which the paper width direction is a longitudinal direction and the paper feeding direction is a lateral direction.

The second detection mark 82 is disposed on the downstream side relative to the nine first detection marks 81 in the paper feeding direction. In other words, the second detection mark 82 is disposed on the most downstream side in the paper feeding direction among the plural detection marks 80.

The nine first detection marks 81 are formed in congruent rectangular shapes. That is, each of the nine first detection marks 81 has a rectangular shape in which a dimension along the paper feeding direction (hereinafter, referred to as "feeding-direction length") is the same as a dimension along the paper width direction (hereinafter, referred to as "width-direction length").

The feeding-direction length of the second detection mark 82 is larger than the feeding-direction length of the first detection mark 81. In other words, the feeding-direction length of the second detection mark 82 is maximized in the plural detection marks 80. The width-direction length of the second detection mark 82 is the same as the width-direction length of the first detection mark 81.

The respective first detection marks 81 and the second detection mark 82 are overlapped with each other when viewed in the paper feeding direction. More specifically, two ends of each of the first detection marks 81 in the paper width direction are aligned with those of the second detection mark 82 when viewed in the paper feeding direction.

The second detection mark 82 and a first detection mark 81 which is adjacent to the second detection mark 82 are arranged with a gap interposed therebetween in the paper feeding direction. In addition, the nine first detection marks 81 are arranged with respective gaps interposed therebetween in the paper feeding direction. In other words, respective margin portions 90 are provided between two adjacent detection marks among the second detection mark 82 and the nine first detection marks 81. The feeding-direction lengths of the margin portions 90 are the same. That is, the feeding-direction lengths of the plural margin portions 90 are constant. Further, the feeding-direction length of each of the margin portions 90 is the same as the feeding-direction length of the first detection mark 81.

The margin portion 90 is an area having a boundary that can be detected by the sensing units 41, 42, 43 relative to the second detection mark 82 and each of the first detection marks 81. It should be noted that no image is formed in the margin portions 90.

On the other hand, each of the ejection heads 32C, 32M, and 32Y is an example of a second ejection unit. The ejection heads 32C, 32M, and 32Y eject ink droplets onto the continuous sheet P at a timing determined as described below by the control device 16.

Any one or two of the ejection heads 32C, 32M, and 32Y may be regarded as an example of the second ejection unit. Therefore, in the present exemplary embodiment, when the ejection head 32K is an example of the first ejection unit, at least one of the ejection heads 32C, 32M, and 32Y can be used as an example of the second ejection unit.

(Sensing Units 41, 42, and 43)

The sensing units 41, 42, and 43 shown in FIG. 1 senses the second detection mark 82 and the nine first detection marks 81, and are disposed between the ejection heads, respectively. Specifically, the sensing units 41, 42, and 43 sense at least a front end of the second detection mark 82 and each of the nine first detection marks 81. The front end is a downstream end in the paper feeding direction. The sensing units 41, 42, and 43 include, for example, a reflection optical sensor.

The sensing unit 41 is disposed between the ejection head 32K and the ejection head 32C in the paper feeding direction. That is, the sensing unit 41 is disposed on the downstream side relative to the ejection head 32K in the paper feeding direction and on the upstream side relative to the ejection head 32C in the paper feeding direction. Specifically, the sensing unit 41 is disposed at a position closer to the ejection head 32C relative to the ejection head 32K. The sensing unit 41 may be disposed at a position which has the same distance from the ejection head 32K and the ejection head 32C, or at a position closer to the ejection head 32K relative to the ejection head 32C.

The sensing unit 42 is disposed between the ejection head 32C and the ejection head 32M in the paper feeding direction. That is, the sensing unit 42 is disposed on the downstream side relative to the ejection head 32C in the paper feeding direction and on the upstream side relative to the ejection head 32M in the paper feeding direction. Specifically, the sensing unit 42 is disposed at a position closer to the ejection head 32M relative to the ejection head 32C. The sensing unit 42 may be disposed at a position has the same distance from the ejection head 32C and the ejection head 32M, or at a position closer to the ejection head 32C relative to the ejection head 32M.

The sensing unit 43 is disposed between the ejection head 32M and the ejection head 32Y in the paper feeding direction. That is, the sensing unit 43 is disposed on the downstream side relative to the ejection head 32M in the paper feeding direction and on the upstream side relative to the ejection head 32Y in the paper feeding direction. Specifically, the sensing unit 43 is disposed at a position closer to the ejection head 32Y relative to the ejection head 32M. The sensing unit 43 may be disposed at a position has the same distance from the ejection head 32M and the ejection head 32Y, or at a position closer to the ejection head 32M relative to the ejection head 32Y.

(Control Device 16)

The control device 16 shown in FIG. 1 controls an operation of each part of the inkjet recording apparatus 10. Specifically, the control device 16 includes a storage unit including a ROM, a storage, or the like in which a program is stored, and a processor that operates according to a program. The control device 16 reads and executes a program and table information stored in the storage unit, thereby controlling the operation of each unit of the inkjet recording apparatus 10.

When the above-described program is executed, the control device 16 realizes various functions by using hardware resources such as a storage unit and a processor. As shown in FIG. 1, the control device 16 includes a detection unit 17 and a control unit 18 that controls driving of the ejection heads 32Y to 32K as a functional configuration.

The detection unit 17 detects each distance from a predetermined origin of the continuous sheet P to the second detection mark 82 and each of the nine first detection marks 81 along the feeding direction. Specifically, the detection unit 17 detects the distance as follows.

Figure 3:
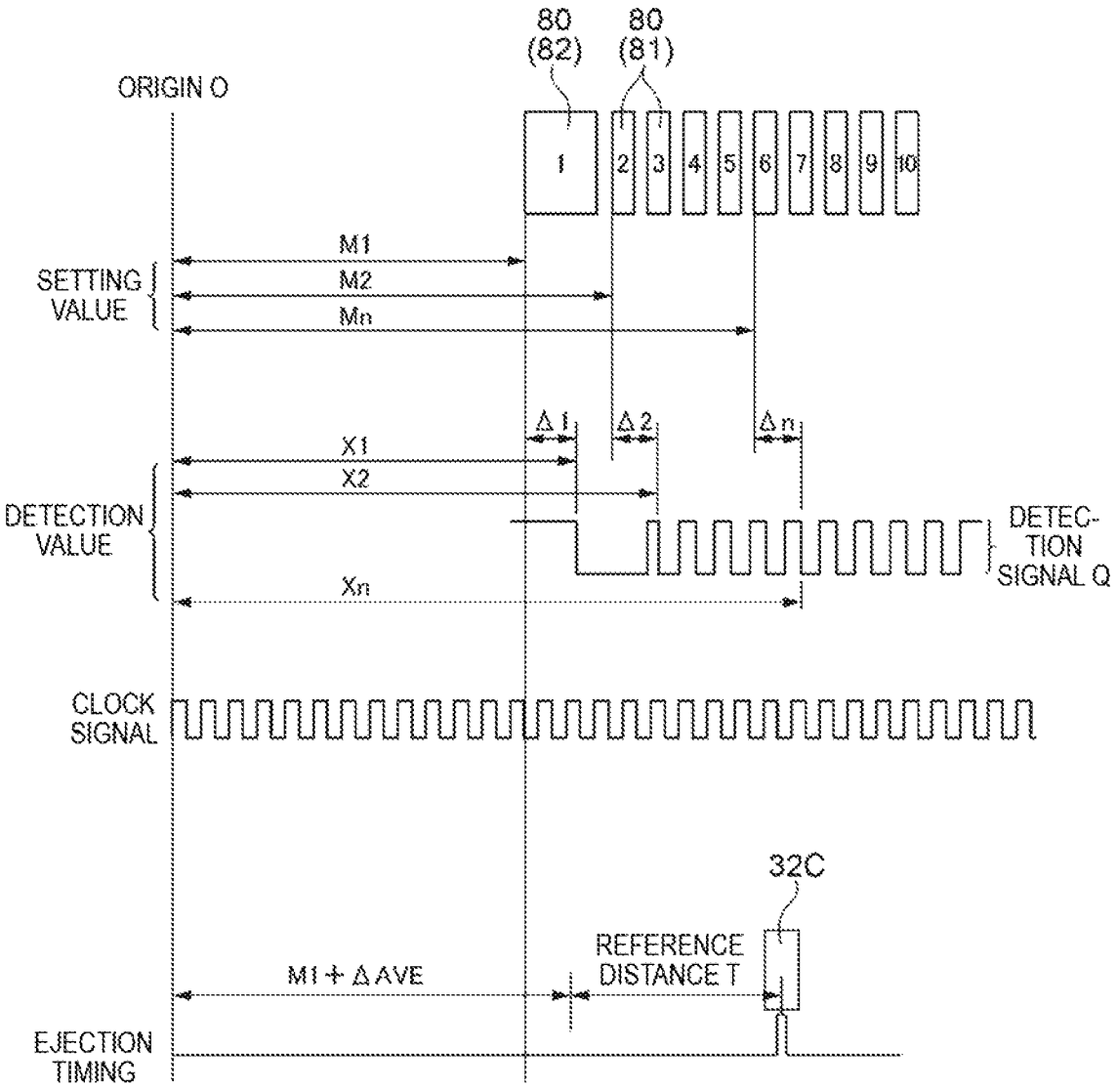
FIG. 3 is a diagram showing a method of calculating an ejection timing of an ejection head according to the present exemplary embodiment.

As shown in FIG. 3, the detection unit 17 generates a clock signal. Further, the detection unit 17 calculates a distance X1 from the origin O to the second detection mark 82 based on the count of the clock signals from the predetermined origin (hereinafter, sometimes referred to as "origin O") of the continuous sheet P to the front end of the second detection mark 82 detected by the sensing unit 41.

Further, the distance from the origin O to each of the first detection marks 81 is calculated from the count of clock signals from the origin O to the front end of each of the first detection marks 81 detected by the sensing unit 41. By calculating in this manner, the detection unit 17 acquires ten detection values.

In FIG. 3, a detection value of the distance from the origin O to the second detection mark 80 (that is, a first detection mark 81 in the first place) is indicated by "X2", and a detection value of the distance from the origin O to the n-th detection mark 80 is indicated by "Xn". The "second" and "n-th" described above are the order when the ten detection marks 80 (the second detection mark 82 and the nine first detection marks 81) are counted from the downstream side to the upstream side in the paper feeding direction. In FIG. 3, a detection signal obtained by detecting the second detection mark 82 and each of the nine first detection marks 81 by means of the sensing unit 41 is shown as a detection signal Q.

The predetermined origin O of the continuous sheet P is, for example, a front end of each page of the continuous sheet P. The origin O is detected, for example, by detecting a mark, which is attached to the continuous sheet P in advance, by the sensing unit 41.

Here, in the control device 16, ten predetermined setting values of distances from the predetermined origin O of the continuous sheet P to the second detection mark 82 and each of the nine first detection marks 81 are stored in the storage unit.

In FIG. 3, a setting value of a distance from the origin O to the second detection mark 82 is indicated by "M1", and a setting value of a distance from the origin O to the second detection mark 80 (that is, a first detection mark 81 in the first place) is indicated by "M2". In FIG. 3, a setting value of a distance from the origin O to the n-th first detection mark 81 is indicated by "Mn".

Then, the control unit 18 of the control device 16 causes the ejection head 32C to eject at a timing based on an addition value obtained by adding an average value of differences between detection values of the detection unit 17 and setting values to a setting value in the second detection mark 82.

Specifically, the ejection head 32C ejects ink droplets onto the continuous sheet P at a timing corresponding to a value obtained by adding a predetermined reference distance T to the addition value. The reference distance T is defined by a distance from the sensing unit 41 to the ejection head 32C and a position where formation of an image is started in each page of the continuous sheet P.

In FIG. 3, a difference (error) between a detection value X1 and a setting value M1 is indicated by "Δ1", a difference between a detection value X2 and a setting value M2 is indicated by "Δ2", and a difference between a detection value Xn and a setting value Mn is indicated by "Δn". In FIG. 3, the average value of the differences between detection values and setting values is represented by "ΔAVE", and the addition value is indicated by "M1+ΔAVE".

Examples of factors for the difference (error) between the detection value Xn and the setting value Mn include the elongation of the continuous sheet P in the paper feeding direction due to swell of the continuous sheet P containing the ink, and a sensing error of the sensing unit 41 (specifically, variation in response time of the sensing unit 41).

Similar to the manner as described above, the control device 16 uses sensing results of the sensing unit 42 to cause the ejection head 32M to eject at a timing based on an addition value obtained by adding an average value of differences between the detection values of the detection unit 17 and setting values to a setting value in the second detection mark 82. Further, similar to the manner as described above, the control device 16 uses detection results of the sensing unit 43 to cause the ejection head 32Y to eject at a timing based on an addition value obtained by adding an average value of differences between the detection values of the detection unit 17 and setting values to the setting value in the second detection mark 82.

Effects of Present Exemplary Embodiment

Figure 4A:
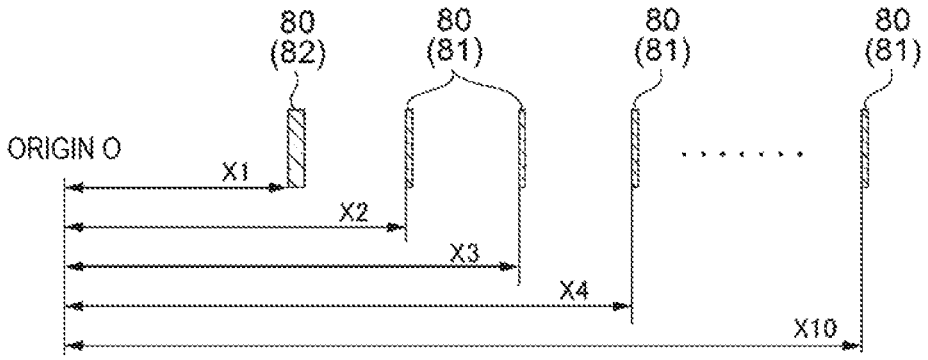
FIGS. 4A and 4B are diagrams showing methods of detecting each distance from an origin to each detection mark in the present exemplary embodiment and a comparative example, respectively.

In the present exemplary embodiment, as described above, the detection unit 17 detects distances X1 to X10 from the predetermined origin O of the continuous sheet P to the second detection mark 82 and the nine first detection marks 81, respectively (see FIG. 4A). The ejection head 32C ejects ink droplets onto the continuous sheet P at a timing based on an addition value obtained by adding an average value of differences between detection values of the detection unit 17 and setting values to the setting value in the second detection mark 82.

Figure 4B:
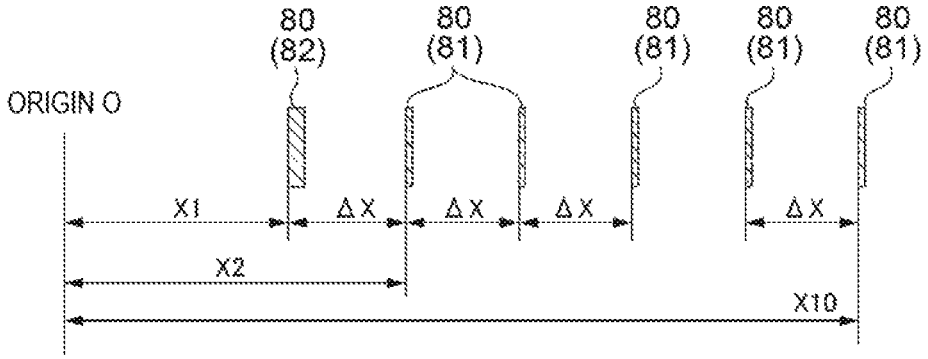
Figure 5:
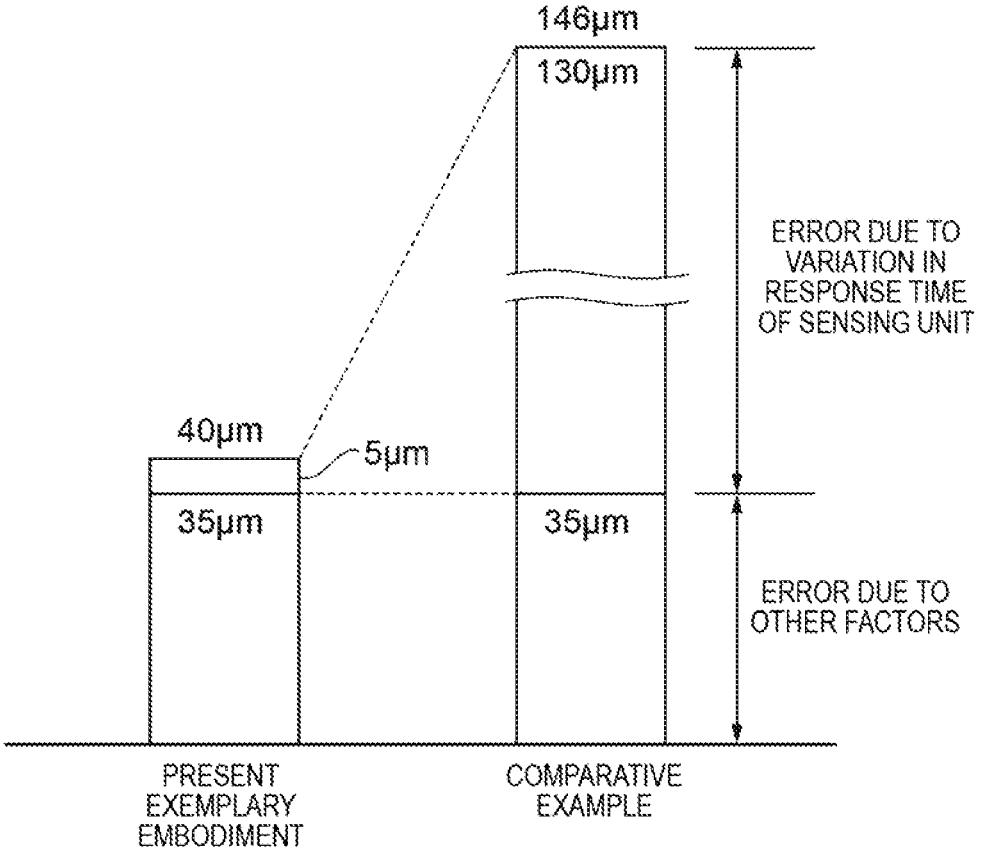
FIG. 5 is a graph showing differences in effects of the present exemplary embodiment and the comparative example.

Here, when the distances X1 to X10 from the origin O to the second detection mark 82 and the nine first detection marks 81 are calculated by detecting a distance X1 from the origin O to the second detection mark 82, and a distance ΔX between the second detection mark 82 and the nine first detection marks 81, and adding the detection value ΔX to the detection value X1 (comparative example, see FIG. 4B), position shift between an ejection position of the ejection head 32K to the continuous sheet P and an ejection position of the ejection head 32C to the continuous sheet P may become large (see FIG. 5). In particular, since the detection error (specifically, the variation in response time of the sensing unit 41) of the sensing unit 41 accumulates, the error increases.

In contrast, since the distances X1 to X10 from the origin O to the second detection mark 82 and the nine first detection marks 81 are detected respectively in the present exemplary embodiment, the position shift between the ejection position of the ejection head 32K to the continuous sheet P and the ejection position of the ejection head 32C to the continuous sheet P is reduced, as compared with the comparative example described above. In particular, the detection error of the sensing unit 41 (specifically, variation in response time of the sensing unit 41) is not accumulated, and an error due to a detection error of the sensing unit 41 decreases (see FIG. 5).

In the present exemplary embodiment, the feeding-direction length of the second detection mark 82 disposed on the downstream side relative to the nine first detection marks 81 in the paper feeding direction is larger than the feeding-direction length of the first detection mark 81.

Therefore, as compared with a configuration in which the feeding-direction lengths of the plural detection marks 80 (nine first detection marks 81 and the second detection mark 82) is constant, the detection failure of the second detection mark 82 disposed on the downstream side relative to the nine first detection marks 81 in the paper feeding direction is prevented because the feeding-direction length of the second detection mark 82 is larger than the feeding-direction length of the first detection mark 81.

In particular, in the present exemplary embodiment, the feeding-direction length of the second detection mark 82 on the most downstream side in the paper feeding direction is larger than that of another detection mark 80 (nine first detection marks 81). Therefore, as compared with a configuration in which the feeding-direction length of the second detection mark 82 on the most downstream side in the paper feeding direction is smaller than that of another detection mark 80 (nine first detection marks 81), a detection failure of the second detection mark 82 on the most downstream side in the paper feeding direction is prevented.

(First Modification)

Figure 6:
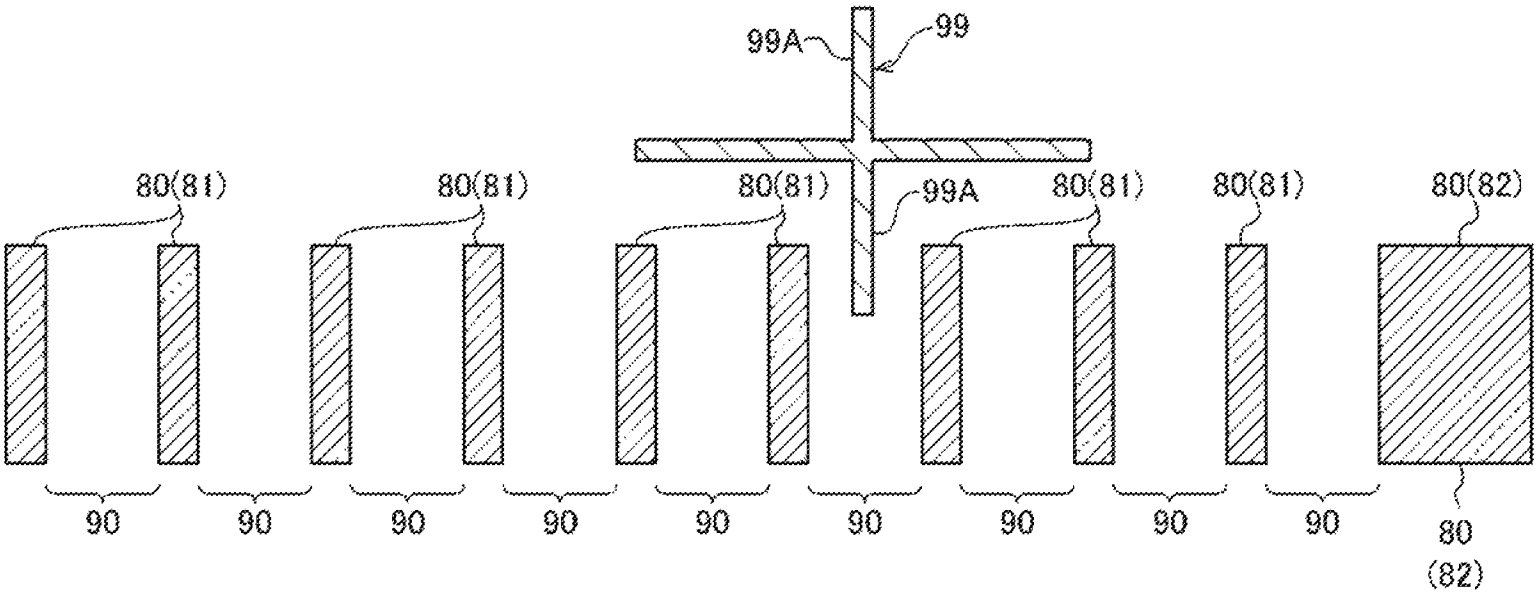
FIG. 6 is a diagram showing a detection mark and a non-target image according to a first modification.

In the present exemplary embodiment, an image is not formed in each of the margin portions 90, but the present invention is not limited thereto. For example, as shown in FIG. 6, the ejection head 32K may form plural detection marks 80 (the second detection mark 82 and the nine first detection marks 81) in the paper feeding direction such that a non-target image 99 that is not detected by the detection unit 17 is disposed in the margin portion 90. An example of the non-target image 99 includes an image such as a mark called a register mark. In FIG. 6, a part of the non-target image 99 (specifically, a vertical line 99A) is disposed in the margin portion 90. The control device 16 does not have a setting value corresponding to the non-target image 99. In other words, the non-target image 99 can be said to be an image for which the control device 16 does not have a setting value.

The non-target image 99 is disposed in the margin portion 90 in the first modification, so that space may be saved on the continuous sheet P as compared with the configuration in which the non-target image 99 is disposed outside the margin portion 90.

(Second Modification)

Figure 7:
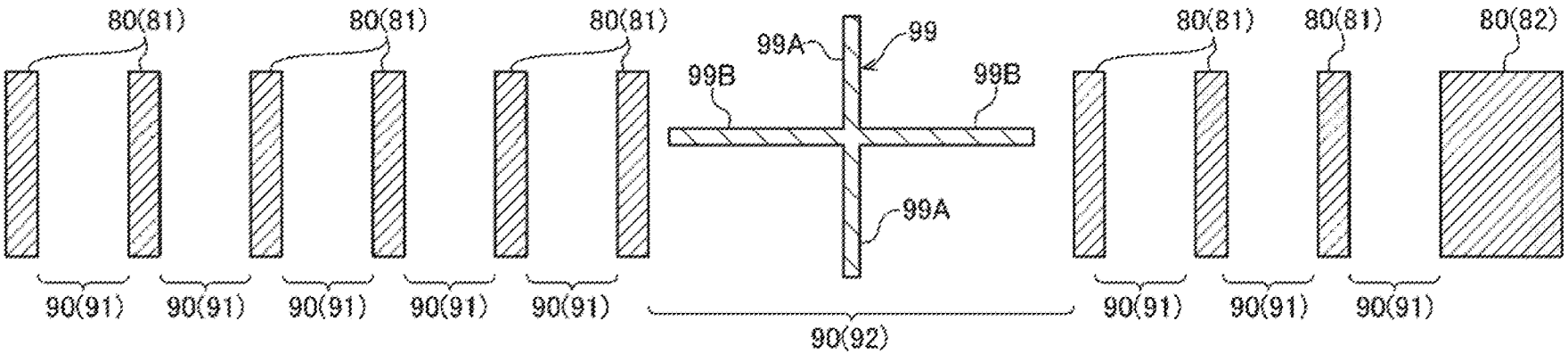
FIG. 7 is a diagram showing a detection mark and a non-target image according to a second modification.

The ejection head 32K may form plural detection marks 80 (second detection mark 82 and nine first detection marks 81) in the paper feeding direction such that a first margin portion 91 and a second margin portion 92 larger than the first margin portion 91 in which the non-target image 99 is disposed are formed as a margin portion 90 as shown in FIG. 7 based on the configuration of the first modification. In FIG. 7, the vertical line 99A and a horizontal line 99B of the non-target image 99 are disposed in the second margin portion 92.

The non-target image 99 is disposed in the second margin portion 92 in the second modification, so that the space may be saved on the continuous sheet P as compared with the configuration in which the non-target image 99 is disposed in the second margin portion 91.

(Other Modifications)

Figure 8:
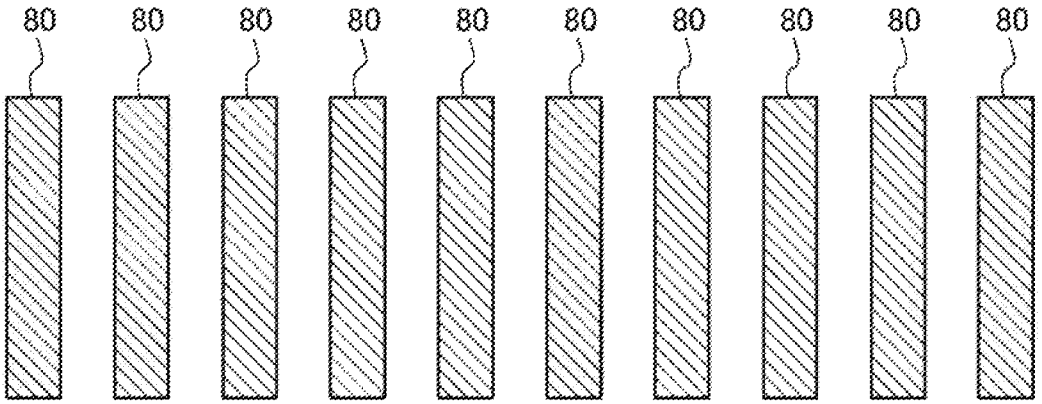
FIG. 8 is a diagram showing a detection mark according to a modification.

In the present exemplary embodiment, the feeding-direction length of the second detection mark 82 is larger than the feeding-direction length of the first detection mark 81, but the present invention is not limited thereto. For example, as shown in FIG. 8, the plural detection marks 80 may have a constant feeding-direction length.

Figure 9:
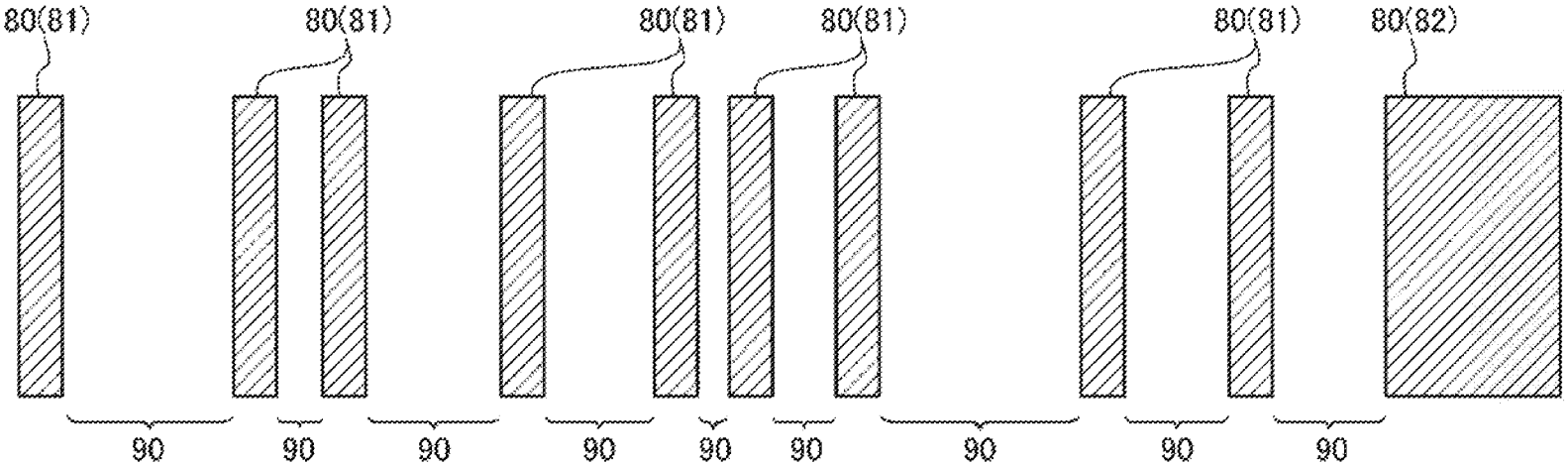
FIG. 9 is a diagram showing a detection mark according to a modification.

In the present exemplary embodiment, the feeding-direction lengths of the plural margin portions 90 are constant, but the present invention is not limited thereto. For example, as shown in FIG. 9, the feeding-direction lengths of the plural margin portions 90 may be partially or entirely different.

Figure 10:
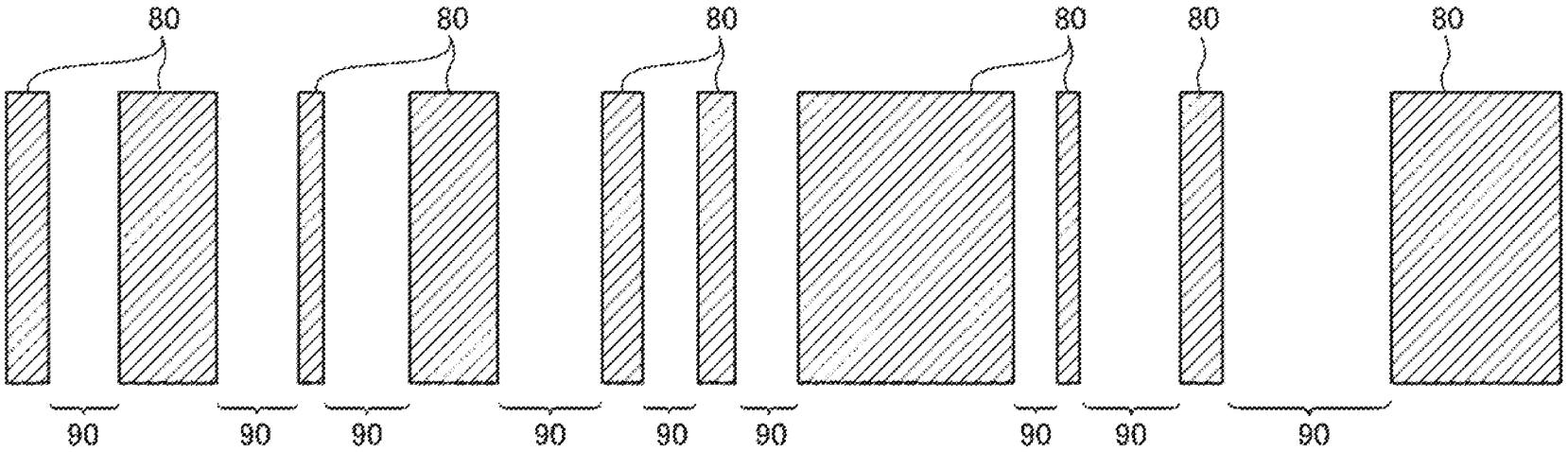
FIG. 10 is a diagram showing a detection mark according to a modification.

In the present exemplary embodiment, the feeding-direction length of the second detection mark 82 disposed on the most downstream side in the paper feeding direction is the maximum in the plural detection marks 80, but the present invention is not limited thereto. For example, as shown in FIG. 10, in the plural detection marks 80, the feeding-direction lengths of the second and subsequent detection marks 80 may be maximized, counting from the most downstream side in the paper feeding direction. More specifically, the feeding-direction lengths of the plural detection marks 80 may be partially or entirely different, and the feeding-direction lengths of the plural margin portions 90 may be partially or entirely different.

Further, ten detection marks 80 are formed as the plural detection marks 80 in the present exemplary embodiment, but the present invention is not limited thereto. For example, two to nine detection marks 80, or eleven or more detection marks 80 may be formed as the plural detection marks 80.

The present invention is not limited to the above exemplary embodiment, and various modifications, changes and improvements can be made without departing from the scope of the invention. For example, the modifications shown above may be combined with each other as appropriate.

What is claimed is:

1. An ejection apparatus comprising:

a feeding unit that feeds a recording medium;

a first ejection unit that ejects droplets onto the recording medium to form a plurality of detection images along a feeding direction of the recording medium, a detection unit that detects a distance from a predetermined origin of the recording medium to each of the detection images along the feeding direction; and a second ejection unit that is disposed on a downstream side relative to the first ejection unit in the feeding direction of the recording medium, and ejects droplets onto the recording medium at a timing based on a value obtained by adding an average value of differences between detection values of the detection unit and setting values to a setting value of the detection image on most downstream side in the feeding direction.

2. The ejection apparatus according to claim 1, wherein the first ejection unit forms, as the plurality of detection images, a first detection image and a second detection image that is disposed on a downstream side in the feeding direction relative to the first detection image and has a dimension along the feeding direction larger than that of the first detection image.

3. The ejection apparatus according to claim 2, wherein the first ejection unit forms the second detection image that is disposed on most downstream side in the feeding direction and has a maximum dimension along the feeding direction.

4. The ejection apparatus according to claim 3, wherein the detection unit detects the distance along the feeding direction based on detection signals of the detection images from a sensing unit disposed between the first ejection unit and the second ejection unit.

5. The ejection apparatus according to claim 3, wherein the first ejection unit forms the plurality of detection images in the feeding direction such that an image that is not a detection target of the detection unit is disposed in a margin portion between the detection images.

6. The ejection apparatus according to claim 5, wherein the first ejection unit forms the plurality of detection images along the feeding direction such that a first margin portion, and a second margin portion which is larger than the first margin portion and in which an image that is not a detection target of the detection unit is disposed are formed as the margin portion.

7. The ejection apparatus according to claim 6, wherein the detection unit detects the distance along the feeding direction based on detection signals of the detection images from a sensing unit disposed between the first ejection unit and the second ejection unit.

8. The ejection apparatus according to claim 5, wherein the detection unit detects the distance along the feeding direction based on detection signals of the detection images from a sensing unit disposed between the first ejection unit and the second ejection unit.

9. The ejection apparatus according to claim 2, wherein the first ejection unit forms the plurality of detection images in the feeding direction such that an image that is not a detection target of the detection unit is disposed in a margin portion between the detection images.

10. The ejection apparatus according to claim 9, wherein the first ejection unit forms the plurality of detection images along the feeding direction such that a first margin portion, and a second margin portion which is larger than the first margin portion and in which an image that is not a detection target of the detection unit is disposed are formed as the margin portion.

11. The ejection apparatus according to claim 10, wherein the detection unit detects the distance along the feeding direction based on detection signals of the detection images from a sensing unit disposed between the first ejection unit and the second ejection unit.

12. The ejection apparatus according to claim 9, wherein the detection unit detects the distance along the feeding direction based on detection signals of the detection images from a sensing unit disposed between the first ejection unit and the second ejection unit.

13. The ejection apparatus according to claim 2, wherein the detection unit detects the distance along the feeding direction based on detection signals of the detection images from a sensing unit disposed between the first ejection unit and the second ejection unit.

14. The ejection apparatus according to claim 1, wherein the first ejection unit forms the plurality of detection images in the feeding direction such that an image that is not a detection target of the detection unit is disposed in a margin portion between the detection images.

15. The ejection apparatus according to claim 14, wherein the detection unit detects the distance along the feeding direction based on detection signals of the detection images from a sensing unit disposed between the first ejection unit and the second ejection unit.

16. The ejection apparatus according to claim 14, wherein the first ejection unit forms the plurality of detection images along the feeding direction such that a first margin portion, and a second margin portion which is larger than the First margin portion and in which an image that is not a detection target of the detection unit is disposed are formed as the margin portion.

17. The ejection apparatus according to claim 16, wherein the detection unit detects the distance along the feeding direction based on detection signals of the detection images from a sensing unit disposed between the first ejection unit and the second ejection unit.

18. The ejection apparatus according to claim 1, wherein the detection unit detects the distance along the feeding direction based on detection signals of the detection images from a sensing unit disposed between the first ejection unit and the second ejection unit.

* * * * *